US007435150B2

(12) United States Patent
Mehiel

(10) Patent No.: US 7,435,150 B2
(45) Date of Patent: Oct. 14, 2008

(54) INTERNAL RIB AND SPINE REINFORCEMENT SYSTEM FOR A HOLLOW SURFBOARD

(76) Inventor: Peter Mehiel, P.O. Box 2273, Carlsbad, CA (US) 92018

( * ) Notice: Subject to any disclaimer, the term of this patent is extended or adjusted under 35 U.S.C. 154(b) by 133 days.

(21) Appl. No.: 11/177,879

(22) Filed: Jul. 5, 2005

(65) Prior Publication Data

US 2007/0010145 A1 Jan. 11, 2007

(51) Int. Cl.
*B63B 5/24* (2006.01)

(52) U.S. Cl. ..... 441/74; 114/357

(58) Field of Classification Search ..... 114/357; 441/74

See application file for complete search history.

(56) References Cited

U.S. PATENT DOCUMENTS 3,593,354 A * 7/1971 Carter ..... 114/357
4,209,867 A * 7/1980 Abrams, III ..... 441/74
4,276,844 A * 7/1981 Fremont ..... 114/39.14
6,692,321 B2 2/2004 Metrot et al.
6,736,689 B2 5/2004 Renard et al.
6,800,006 B1 10/2004 Itnyre et al.
6,827,617 B2 12/2004 Metrot et al.
2004/0011275 A1 * 1/2004 Broom ..... 114/347
2004/0198112 A1 10/2004 Renard et al.

* cited by examiner

*Primary Examiner*—Stephen Avila
(74) *Attorney, Agent, or Firm*—Joseph Curtis Edmonds; John Bargero

(57) ABSTRACT

A surfboard that has a hollow inner volume which contains a longitudinally oriented reinforcement system or spine, with laterally arranged branches or ribs. The reinforcement system is spaced both from the nose of the surfboard and from the tail of the surfboard, while the ribs or branches radiate from the spine towards each side of the board in various spine and rib configurations to provide an optimal balance between weight, strength and flex.

1 Claim, 5 Drawing Sheets

INTERNAL RIB AND SPINE REINFORCEMENT SYSTEM FOR A HOLLOW SURFBOARD

BACKGROUND

This invention relates to sporting goods, more precisely towards those used in water, such as surfboards, kite boards, sailboards, wind surfers, wakeboards and sailboats.

Since the mid 1960's, surfboards have been constructed of a foam core surrounded by a fabric, the most common being fiberglass, which is saturated with a polyester or epoxy resin. For over forty years, the vast preponderance of surfboards produced were constructed in this manner. With construction materials being almost constant, the performance characteristics of a foam/glass board was and still is largely determined by its shape. Shapers have emerged as the icons of the industry who bring new models out each year—all made of foam and glass. Competitive surfers demand ever lighter, ever faster boards, and forty years of refinement has taken the shaper's artistry to its limit. Today's foam/glass boards are thin, fragile, subject to dings and cracks that absorb water and weaken the board, which ultimately fails. An active surfer will break boards every season, and pro surfers break 60 or more boards a year. Even with no damage, the individual foam cells eventually lose their elasticity, and the board 'goes dead'. The industry is desperate for new technology.

Although shape is arguably the most important factor in board performance, other physical properties such as weight, center of mass, torsional and longitudinal rigidity are significant factors which must be controlled to allow the surfer maximum speed and control of the board.

Rigidity is an important factor in controlling the surfboard and must be carefully balanced for optimal performance. In extreme maneuvers, such as abrupt turns, this board can slightly flex affecting the type of water flow around it. In essence, we can retard the transition from laminar flow to turbulent flow by decreasing the board's rigidity. Laminar flow is preferred for maximum control of the board, but once again excessive board flex will adversely affect performance. A balance must be struck, and this suspension system allows the hull to act dynamically. Although, there have been several attempts at solving these problems, none do it as efficiently as this invention.

U.S. Pat. No. 6,800,006 B1 discloses a hollow surfboard with a longitudinal reinforcement system, but does not disclose the unique system of radiating lateral ribs that provide additional reinforcement and rigidity to the board, and does not address the different forces acting on deck and hull.

U.S. Pat. No. 6,827,617 B2 discloses a hollow surfboard with support zones that are designed to withstand the normal force of the surfer's weight to prevent collapse of the structure and does not affect the dynamics of the board.

U.S. Pat. No. 6,736,689 B2 discloses a hollow foam surfboard with a longitudinal support structure fabricated of machinable foam.

U.S. Pat. No. 6,692,321 B2 discloses a hollow foam surfboard with a longitudinal member that has the functions of stiffening the board and providing inertial mass.

U.S. Pat. No. 6,652,340 B2 discloses a surfboard with a rigid internal frame comprising of two c-shaped rails that form the outer perimeter of the board.

None of the aforementioned patents teach the use of a rib and spine-like interior reinforcement system that is suspended from the deck and stiffens the deck while allowing the hull to remain flexible. The strength to weight properties of carbon fiber laminates used in the spine & rib suspension system create a very unique product. The strength and stiffness is concentrated in the deck which is in direct contact with the surfer's feet, and thus transfers energy efficiently without the dampening, energy absorbing properties of foam. Also, this novel configuration allows for the direct attachment of the fin box to the suspension system. By attaching the fin box, which can be a piece of material, such as plastic, metal, or other rigid material that has a slot to insert and secure a fin, the energy needed to carve turns or other maneuvers is efficiently to the rail, or peripheral edge of the board, where most maneuvers begin. Solid foam boards and hollow boards with deck and hull connected dampen and absorb too much energy and adversely affect performance.

SUMMARY OF THE INVENTION

The present invention discloses a novel hollow surfboard that combines a balance between weight, strength, and flex distributed throughout the board in a manner desired by surfers.

One embodiment has a deck fabricated from a laminate having an outer layer, an intermediate core fabricated from a honeycomb or other light weight material, and an inner layer under the honeycomb material. These layers can be made of a composite. The deck portion is joined to a bottom portion (or hull) also fabricated from a laminate having an outer layer, an inner core, and a bottom layer. These layers can also be made of a suitable material, such as a composite. A reinforcement system comprising elongated members arranged in a rib and spine-like configuration is fixed to the inner surface of the deck. The reinforcement system can also be integrated into the deck that is, the deck and the reinforcement system is molded as a single piece which is itself part of the internal wall of the deck.

This reinforcement system can be made from a rigid material such as carbon fiber or a flexible material that becomes rigid by the application of a catalyst. The reinforcement system is comprised of a spine, which is positioned longitudinally and may vary in length from a fraction of the overall length of the board to virtually the entire length and may be closer to the tail or to the nose. This member may have different cross sectional geometries, that is, for example it could be square, rectangular, round, oval shaped, or triangular in cross section, depending on the stiffness and strength required. The ribs extend from the spine outwards toward the rails, or outside edges of the board. The angle between ribs and spine may vary from 90 degrees (perpendicular) to very acute angles. Spacing between ribs along the spine may vary from a few inches to as much as several feet or more. Altering the rake angle and spacing of the ribs or the spine and rib dimensions, such as thickness, length, and width will produce almost an infinite variation of 'stiffness', 'flexibility' or resistance to torsion of both the deck itself and the entire surfboard. Also, variations in the ribs' cross sectional geometry, in a similar fashion as mentioned in the spine description, may impart favorable characteristics to the board. Lastly, the top surface of the fin boxes (17) can be fixed to the inner surface of the deck to create a connection from the surfer's feet to the fins for even greater control and maneuverability.

In another aspect, the deck mounted suspension system is connected in one or more places between its lower surface and the inner surface of the hull to transfer and distribute stresses. Even though this may adversely affect flexural properties, it is sometimes required where extreme strength is the primary characteristic desired. Even in this instance, the rib and spine deck reinforcement system imparts unique and desirable properties to the surfboard.

DETAILED DESCRIPTION

While describing the invention and its embodiments various terms will be used for the sake of clarity. These terms are intended to not only include the recited embodiments, but also all equivalents that perform substantially the same function, in substantially the same manner to achieve the same result.

Figure 1:
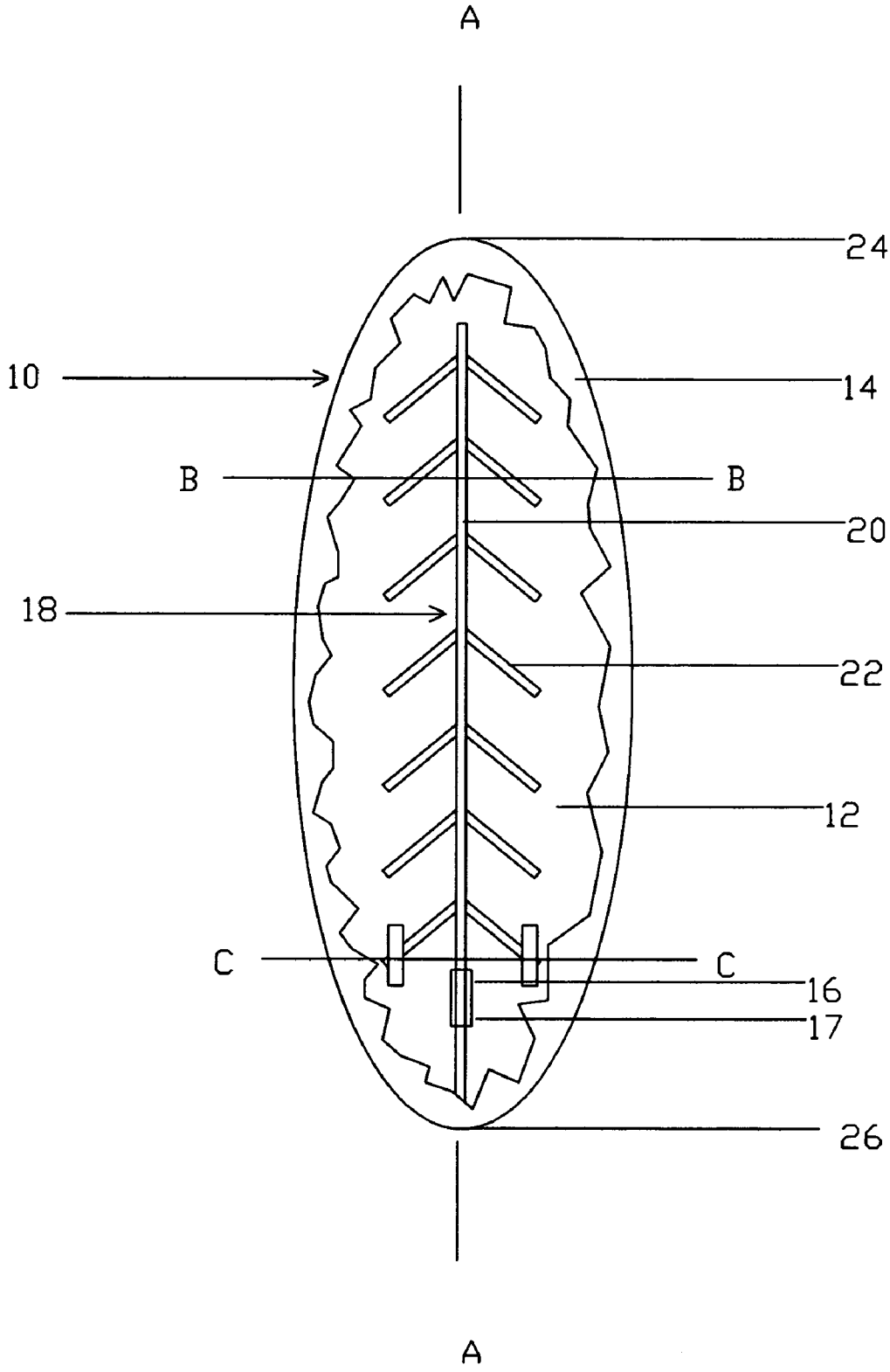
FIG. 1 is a top view of the surfboard with the top deck cut away to expose the reinforcement system.

A surfboard of the present invention, with the deck cut away to reveal the deck reinforcement system 18, is shown in a top-view in FIG. 1 and indicated generally by reference character 10. Surfboard 10 has a hull 12, a deck 14, a fin 16 and a fin box 17. The fin 16 itself is an after market item and typically more than one fin is used The fin 16 can be seen in FIG. 2, which is a cross-sectional view along the length of the surfboard.

Figure 3:
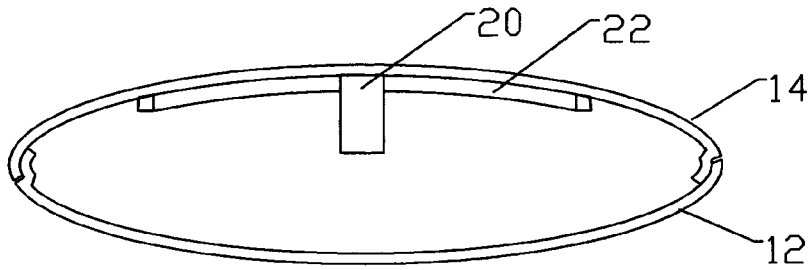
FIG. 3 is a cross sectional view of the surfboard taken along line b-b of FIG. 1.

In FIG. 1 the reinforcement system is indicated generally by reference character 18 and has a spine 20 and ribs 22, constructed of a rigid material, such as a laminate of carbon fiber over a core material, and fixed to the deck. The reinforcement system is fashioned in a rib and spine-like pattern, such as the configuration of a fish's skeletal structure. In another alternative, the support structure itself can be formed out of the core material itself and sandwiched between two layers of laminate. The spine 20 runs the length of the board from nose 24 to the tail 26. It may be shorter or longer, thinner or thicker, shaped differently or positioned asymmetrically depending on characteristics desired. As shown in FIG. 3, one or more ribs 22 attach to each side of the spine 20 and are positioned parallel to the deck 14.

Figure 4:
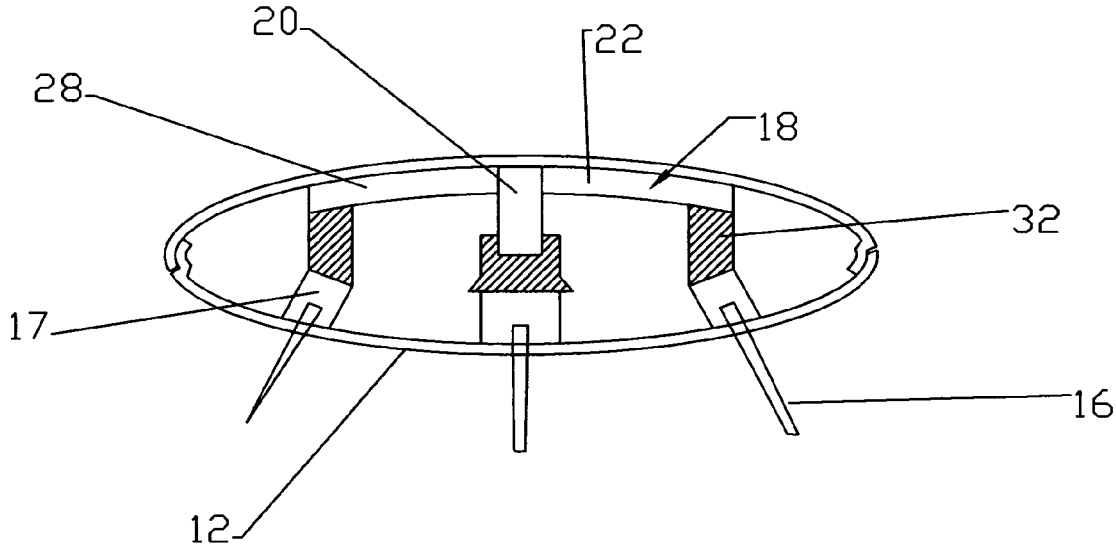
FIG. 4 is a cross sectional view of the surfboard taken along line c-c of FIG. 1.

In another variation of the reinforcement system 18 the spine 20 and ribs 22 are manufactured as a single integrated unit, as shown in FIG. 4, the upper surface of the reinforcement system 18 is attached to the inner surface of the deck 14. The lower surface of the reinforcement system 18 is connected to the fin boxes 17. In some instances the lower surface of the reinforcement system is fixed to the inner surface of the hull 12, through a damper, which can be a layer of urethane foam, PVC, methacrylate, acryllic, or epoxy/carbon fiber laminate or similar material, 32.

Figure 7:
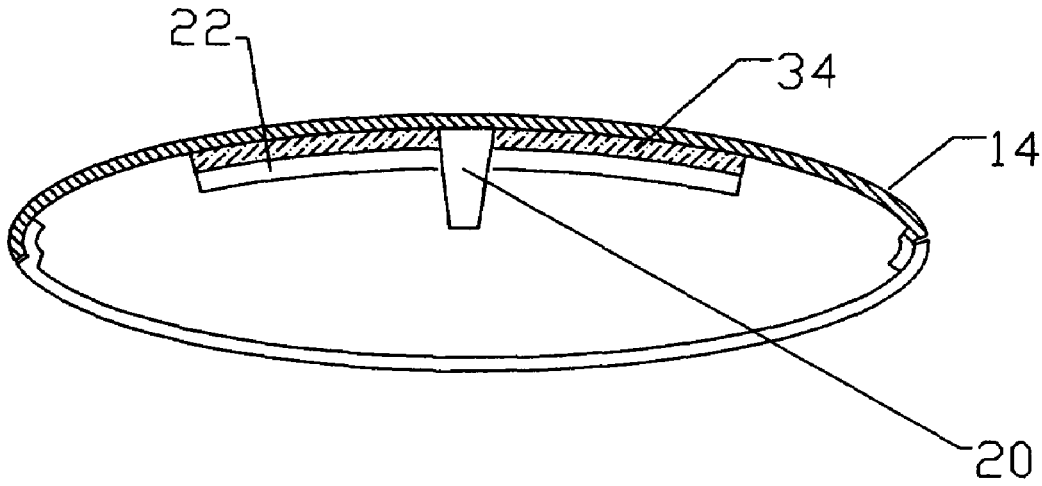
FIG. 7 is a cross-sectional view analogous to FIG. 3 depicting an alternate embodiment of the reinforcement system.
Figure 8:
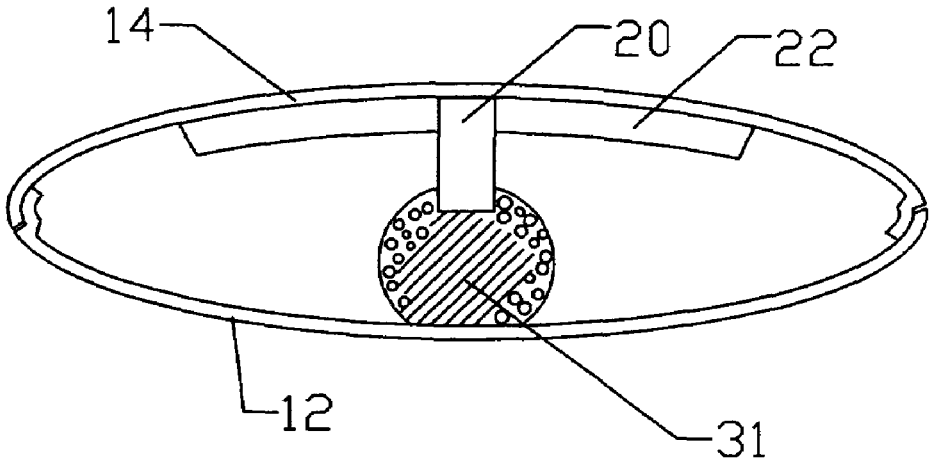
FIG. 8 is a cross-sectional view analogous to FIG. 3 depicting an alternate embodiment of the reinforcement system.

In this embodiment the deck 14 and hull 12 are formed separately after which the reinforcement system is adhered to either the inner surface of the deck or the inner surface of the bottom. While in other contemplated embodiments, the deck 14 and the reinforcement system 18 are formed as a single unit. After the deck and hull are joined, the lower surface of the reinforcement system 18 is adhered to the inner surface of the hull 12 by the use of expansion foam, or other compressible adhesive 32. A vibration-dampening layer 34 may be added between the inner surface of the deck 14 and the upper surface of the reinforcement system 18, shown in FIG. 7. Likewise, a vibration-dampening layer may be added between the urethane foam 31 or the inner surface of the hull 12 and the reinforcement system as shown in FIG. 8.

Figure 2:
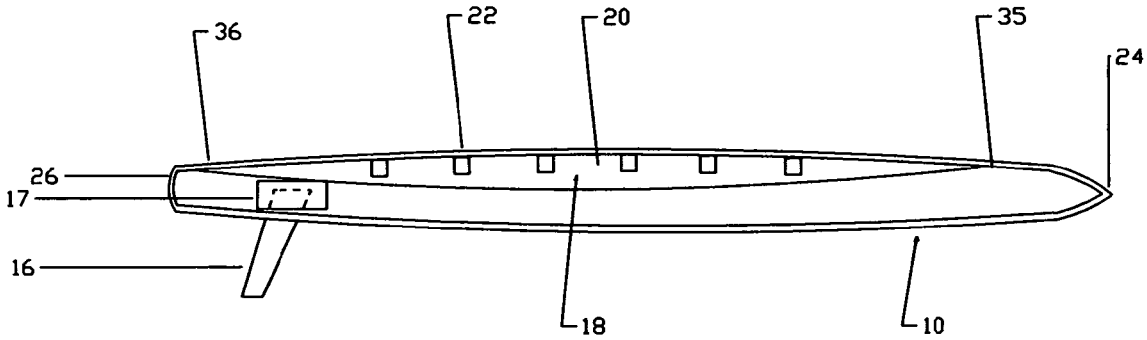
FIG. 2 is a cross-sectional view of the surfboard taken along line a-a of FIG. 1.

The board is shown in cross-sectional side view in FIG. 2. The length, placement, shape, and overall configuration of the reinforcement system 18 provides an immense potential for control of the finished board's flexibility. For instance, the distance between forward end 35 of the reinforcement system 18 and nose 24 affects the flexibility of the nose portion of the board. The larger this space, the more the nose will flex. Similarly, the distance between rear end of the reinforcement system 36 and tail 26 affects the flexibility of the tail.

As also seen in FIG. 2, reinforcement system 18 may be tapered to fit the inner shape of the hollow board 10.

Several variables of the reinforcement system 18 also affect the flexibility of the reinforcement system, and thus, the finished board. These variables include the material used for the spine 20 and ribs 22, such as carbon fiber, fiberglass, or a myriad of other materials with different modulus of elasticity and yield strengths. Also, the number and spacing of the ribs 22 along the spine 20, the length of the ribs 22, and the ribs 22 angle will affect the board's strength and flexibility. Varying the cross sectional dimension, or the cross sectional geometry or shape of the spine 20 and ribs 22 will also alter the board's strength and rigidity.

The preferred embodiment discloses a symmetrical configuration for spine 20 and ribs 22. Alternate embodiments will include differing the number of ribs on each side of the spine 20, varying the angles and lengths of each of the individual ribs 22, varying the size of each of the ribs 22. Furthermore, the preferred embodiment discloses a reinforcement system 18 comprising of elements with rectangular cross sections; however, various different elements of different geometrical cross sections may be substituted in various combinations, such as triangular shaped members, oval shaped members or circular rods, or a combination of these.

Figure 5:
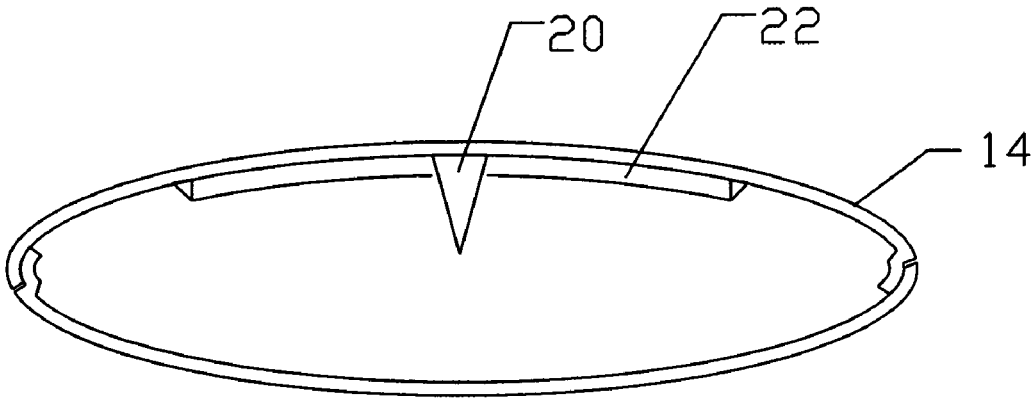
FIG. 5 is a cross-sectional view analogous to FIG. 3 depicting an alternate embodiment of the reinforcement system.
Figure 6:
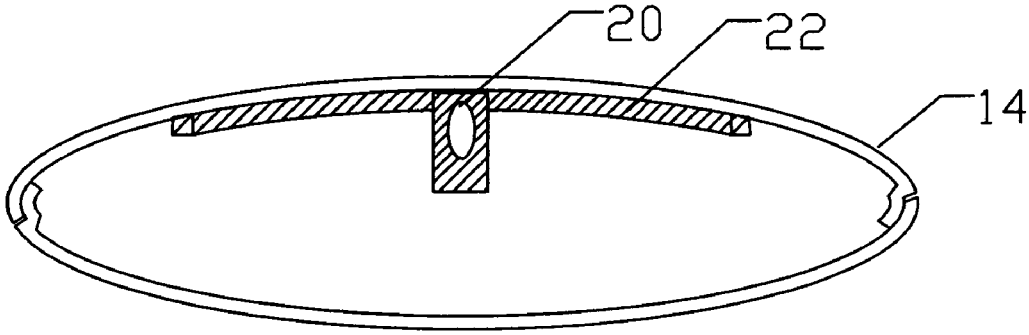
FIG. 6 is a cross-sectional view analogous to FIG. 3 depicting an alternate embodiment of the reinforcement system.

FIG. 5 depicts the ribs 22 and the spine 20 as being constructed of triangular shaped members. While, FIG. 6 depicts the ribs 22 and the spine 20 as being constructed of a combination of different shaped members.

The choice of fabric also affects the flexibility of the board, while carbon fibers provide a stiffer reinforcement system than does E-glass™ or Kevlar™. Those skilled in the art will readily adapt a myriad of combinations of reinforcement system length, thickness, or outer fabric within the scope of the present invention.

The end product is a surfboard which is lighter than conventional urethane foam cored surfboards, yielding a surfboard that can weigh roughly half that of conventional surfboards and which is many times stronger and more durable. The reduction in weight allows the surfer to maneuver the board with proportionally less effort. While the invention's use in surfboards has been emphasized, it is, of course, to be understood that the invention can be used for any hollow water supported object, such as wind surfers, wake surfers, kite surfboards, wake boards, or sail boats. In these applications, the same combination of lightweight, strength, and variable flexibility are very useful.

The invention has been described in terms of the preferred embodiment. One skilled in the art will recognize that it would be possible to construct the elements of the present invention from a variety of means and to modify the placement of the components in a variety of ways. While the embodiments of the invention have been described in detail and shown in the accompanying drawings, it will be evident that various further modifications are possible without departing from the scope of the invention as set forth in the following claims.

I claim:

1. A craft comprising: a) an upper deck fabricated from an upper core sandwiched between upper and lower layers and said upper deck having a deck peripheral edge, and b) a hull fabricated from a lower core sandwiched between upper and lower composite layers and said hull having a bottom peripheral edge wherein said hull peripheral edge is joined to said deck peripheral edge thereby defining an interior space and having a nose and a tail and a craft length between the nose and tail, and c) a reinforcement system, said reinforcement system having an upper surface, a lower surface, a forward end, a rear end, a width and a length and said upper surface of the reinforcement system adhered to the inner surface of the deck, and d) at least one fin box located in said interior space to accommodate a fin protruding through the hull of the craft away from the deck surface; and wherein said reinforcement system is at least partially encapsulated within said upper core.

* * * * *